United States Patent [19]

Jostler

[11] Patent Number: 4,756,144

[45] **Date of Patent: * Jul. 12, 1988**

[54] APPARATUS FOR FORMING INDIVIDUAL PACKAGES FROM A CONTINOUS BELT

[75] Inventor: Jan Jostler, Halmstad, Sweden

[73] Assignee: Joker Systems AB, Sweden

[ * ] Notice: The portion of the term of this patent subsequent to Dec. 17, 2002 has been disclaimed.

[21] Appl. No.: 865,886

[22] Filed: May 21, 1986

Related U.S. Application Data

[60] Division of Ser. No. 742,926, Jun. 10, 1985, Pat. No. 4,598,421, which is a continuation of Ser. No. 354,082, Jan. 29, 1982, Pat. No. 4,558,556.

[30] Foreign Application Priority Data

Jun. 30, 1980 [SE] Sweden ..... 8004829

[51] Int. Cl.[4] ..... B65B 9/06

[52] U.S. Cl. ..... 53/568; 53/570

[58] Field of Search ..... 53/372, 450, 459, 468, 53/469, 570, 578, 568; 141/10, 114, 68, 313; 206/390; 229/69; 383/7, 22, 37

[56] References Cited

U.S. PATENT DOCUMENTS

| | | | |
|---|---|---|---|
| 3,599,388 | 8/1971 | Feingold | 53/459 X |
| 3,744,211 | 7/1973 | Titchenal et al. | 53/459 |
| 3,791,573 | 2/1974 | Titchenal et al. | 229/69 |
| 3,813,845 | 6/1974 | Weikert | 53/459 X |
| 3,817,017 | 6/1974 | Titchenal | 53/459 X |
| 4,291,517 | 9/1981 | Lipes | 53/468 |
| 4,558,556 | 12/1985 | Jostler | 53/568 X |

FOREIGN PATENT DOCUMENTS

| | | | |
|---|---|---|---|
| 1436118 | 5/1976 | United Kingdom | 53/459 |

*Primary Examiner*—Robert L. Spruill
*Assistant Examiner*—Steven P. Weihrouch
*Attorney, Agent, or Firm*—Roberts, Spiecens & Cohen

[57] ABSTRACT

An apparatus for forming individual packages from a continuously flexible belt displaying two opposing walls (5, 6) and longitudinal upper and lower edges and incorporation a number of consecutively arranged packaging blanks (2), each with a bottom section (4) at the aforementioned lower edge and two bonding zones (7, 8) arranged transversely in relation to the longitudinal direction of the belt which form the side closures of the packaging blank. In accordance with the invention the belt incorporates two strip sections (10, 11) arranged mainly opposite each other which extend in the longitudinal direction of the belt at its aforementioned upper edge and which are demarcated from the packaging blanks (2) by a tear initiation (12) arranged in each wall parallel with the aforementioned upper edge, whereby each strip section (10, 11) is provided with a continuous suspension device (17, 18) for interacting with packaging blank opening guide devices (19, 20) arranged at a filling station for filling the packaging blanks, both walls of the belt also being provided with slots which have a vertical slot portion (14) arranged between the bonding zones (7, 8) of two adjacent packaging blanks and a horizontal slot portion (16) arranged on either side of the aforementioned vertical slot portion and between the packaging blanks and the suspension devices, whereby two adjacent horizontal slot portions (16) are arranged at a distance from each other.

16 Claims, 2 Drawing Sheets

APPARATUS FOR FORMING INDIVIDUAL PACKAGES FROM A CONTINOUS BELT

This is a divisional of application Ser. No. 742,926, filed 6/10/85, now U.S. Pat. No. 4,598,421, which is a continuation of Ser. No. 354,082, filed 1/29/82, now U.S. Pat. No. 4,558,556.

The present invention relates to a continuous flexible belt which displays two opposing walls and longitudinal upper and lower edges and which incorporates a number of consecutively arranged packaging blanks each with a bottom section at the aforementioned lower edge and two bonding zones arranged transversely in relation to the longitudinal direction of the belt which form the side closures of the packaging blank. The packaging blanks are filled at a filling station and the apparatus comprises guide devices for opening the packaging blanks.

PRIOR ART

British patent No. 1 509 639 describes a device for filling bag-shaped packagings of fabric material which are advanced by means of two drive belts in engagement with the outer sides of the packaging belt. The packagings are opened by means of a linkage mechanism and attendant interacting guide devices. The device is complicated and does not satisfy present-day demands for low costs of packaging different kinds of articles. In any event, the device is not suitable for filling in bags of plastic material which are arranged in the form of a continuous belt.

SUMMARY OF THE INVENTION

An object of the present invention is to provide a continuous belt of packaging blanks which permits the use of a simplified device for filling the packaging blanks in a simple and reliable manner, particularly packaging blanks of a plastic material.

This is achieved according to the present invention, in that the continuous belt incorporates two principally opposing strip sections which extend in the longitudinal direction of the belt at its upper edge and which are demarcated from the packaging blanks by means of a tear initiation in each wall arranged parallel to the upper edge, whereby each strip section is provided with a continuous suspension device for cooperating with packaging blank opening guide devices arranged at a filling station for filling the packaging blanks, in addition to which the belt is provided with slots in both walls, each having a vertical slot arranged between the bonding zones of two adjacent packaging blanks and a horizontal slot formed in advance or in conjunction with the filling operation on either side of the vertical slot and between the packaging blanks and the suspension devices, whereby two adjacent horizontal slots are arranged at a distance from each other.

The simplified device according to the invention is characterized in that the guide devices consist of two adjacent guide bars arranged in the same place for co-acting with the specified belt, whereby the guide bars display end sections which are situated in the vicinity of each other and center sections which are situated at a distance from each other, these centre sections being arranged to separate the strip sections of the belt in conjunction with the opening of the packaging blanks, whereby the desired material or object is placed in the packaging blanks.

BRIEF DESCRIPTION OF THE VIEWS OF THE DRAWING

The invention is described in greater detail of the following with reference to the drawing, wherein.

DETAILED DESCRIPTION

Figure 1:
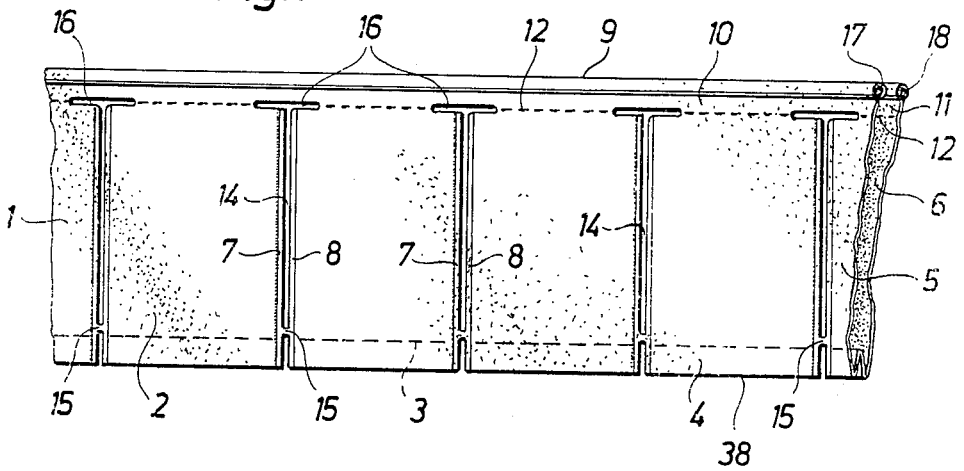
FIG. 1 is a side view of a longitudinal cross-section of a continuous belt according to the present invention.

With reference to FIG. 1, a section of a continuous belt 1, which incorporates a number of consecutively arranged packaging blanks 2, is shown. The belt has been formed by folding a broader material belt along its center line 3 to form a bottom section 4 of the packaging blanks, the bottom section being folded inward as shown in FIG. 1 during formation of the lower edge 38 of the belt. The opposing walls 5, 6 obtained through folding are joined to each other at regular intervals to form bonding zones 7, 8 which extend at right angles to the bottom section 4 of the packaging blanks. The bonding zones, which can be formed by welding gluing, or by any other suitable means, demarcate each packaging blank laterally and extend from the bottom section 4 to an upper point which is situated at a predetermined distance from the upper edge 9 of the belt. The continuous belt also incorporates two longitudinal strip sections 10, 11 which comprise the upper areas of the walls formed through folding and which are demarcated from the packaging blanks by a longitudinal perforation 12 in each wall or other tear initiation which extends principally through the upper points in the bonding zones. The perforation 12 consequently demarcates the packaging blanks at the top and defines the position of their openings 13.

Arranged in or between the bonding zones 7, 8 are vertical slots 14, and each slot 14 may be interrupted by one or more bridges 15 which hold the packaging blanks in a line after each other. Further, horizontal slots 16 are arranged in the area for the boundary between the packaging blanks and the upper strip sections 10, 11, i.e. according to the version disclosed in line with the horizontal perforation 12, whereby these horizontal slots 16 are located adjacent to the vertical slots 14 and joined to them in the form of a T. As will be evident from FIG. 1, two adjacent horizontal slots 16 are arranged at a distance from each other. The slots are arranged in both walls 5, 6 as also is the perforation 12.

The two strip sections are both provided with suspension devices which in the version disclosed consist of sections of the walls 5, 6 folded and welded to form longitudinal tunnels 17, 18 of predetermined size.

Figure 2:
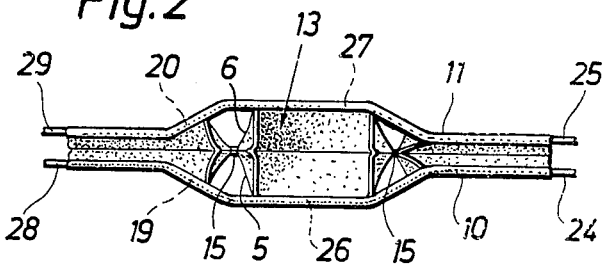
FIG. 2 shows the belt in FIG. 1 from above as it is advanced in a filling station.
Figure 3:
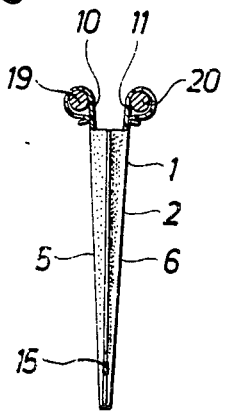
FIG. 3 is a cross-section through the belt along line III—III in FIG. 4.
Figure 4:
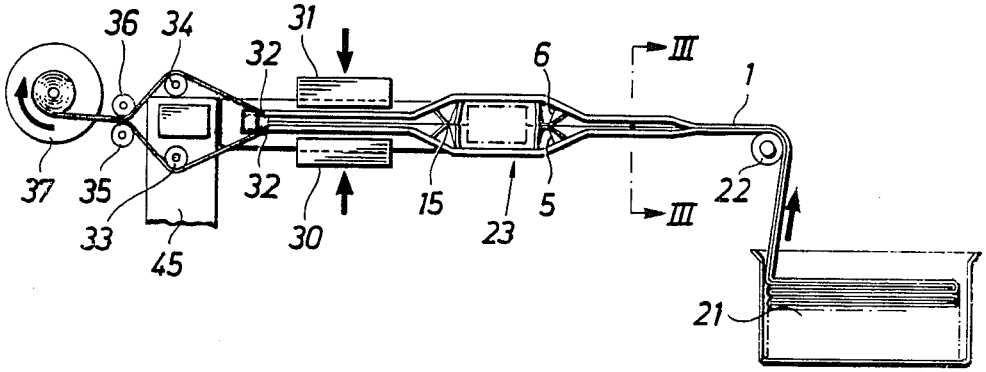
FIG. 4 shows schematically from above a device for handling a belt as in FIG. 1 from magazine to finished packagings.

The aforementioned suspension devices, which are continuous, are arranged to cooperate with special guide devices in the form of two guide bars or guide arms 19, 20 arranged in the same horizontal plane over which the suspension devices easily slide as the belt is advanced. An arrangement incorporating such guide devices is shown schematically in FIGS. 2 and 4. A continuous belt 1 is advanced from a magazine 21 in the version shown in FIG. 4 over a roller 22 to a filling station 23 which incorporates the aforementioned guide devices in the form of the two guide bars 19, 20 arranged in the same horizontal plane which extend through the tunnels of the strip sections. Viewed in the direction of travel, the bars display parallel end sections 24, 25 which are located upstream and situated in close proximity to each other and which open into centre sections 26, 27 which are situated at a predetermined distance from each other and which are partially parallel. Alternatively, they may be completely arc-shaped. The end sections 28, 29 located downstream are similarly parallel and situated in close proximity to each other. Situated in the area for the end sections 28, 29 are, in the version disclosed, two interacting welding jaws 30, 31 (FIG. 4) for sealing the packaging blanks after they have been filled at the filling station. The two bars 19, 20 are stationary and are supported by a stand (not shown) at their end sections 28, 29 situated downstream, whereby the transition sections between the bars and the two vertical parts of the stand are arranged with sharp edges to form cutting device 32 for cutting open the tunnels of the strip sections as the belt 1 is advanced. The arrangement also incorporates two opposing guide rollers 33, 34 which bring about such a change in the feed direction of the strips in relation to each other and to the belt that they are torn loose from the belt and from the filled packaging blanks which are collected at a receiving station. From the guide rollers 33, 34 the two strip sections are brought together over guide rollers 35, 36 and collected on a common take-up roller 37 which is arranged to be driven by a drive device (not shown) in the direction indicated by the arrow. The continuous belt is consequently advanced through the drive of the take-up roller 37, whereby the strip sections are accordingly pulled forward over the two guide bars which are arranged to guide the strip sections away from each other at the same time as the packaging blanks are opened so that each blank can be filled with the desired material or object. Opening is made possible, i.e. without damaging the packaging blanks, by the presence of the horizontal slots 16 whose length is chiefly the same as, or slightly more than, the distance between the two bars at their center sections. The bridges 15 can be severed by means of a suitable cutting device at the filling station as has taken place in the version according to FIG. 2 or at another suitable point situated downstream.

A supporting belt or conveyor belt, which primarily extends from the filling station, supports the packaging blanks with their contents. The finished packagings are subsequently received on a conveyor belt 45 which carries the packagings to a receiving station for packing or other handling.

The horizontal slots 16 are formed in advance in the walls at the same time as the vertical slots 14. Alternatively, at least the horizontal slots can be formed in the walls before opening and filling of the packaging blanks, e.g. in close proximity thereto or after the belt has left its magazine 21. Lateral folding of the angular sections between the horizontal and vertical slots will thus be avoided as the belt is advanced, particularly if it is advanced horizontally, unless upper uniting bridges are used.

In the version disclosed, the length of the center sections 26, 27 of the bars is such that a packaging blank 2 can be held fully open between them. If desired, these center sections 26, 27 can nevertheless be extended so that two or more packaging blanks can be opened simultaneously. The belt can be advanced intermittently or continuously, whereby in the latter case the filling device follows the movement of the belt in the filling station. The filling device may incorporate a funnel, e.g. when the material that is to be packaged is in liquid form or in free-running particle form. Alternatively, it may consist of mechanical transfer arms or a conveyor belt. Filling can of course also be carried out manually.

Figure 5:
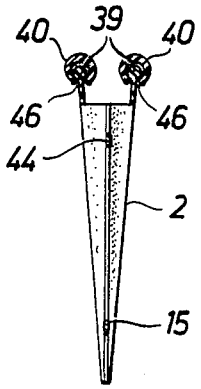
FIG. 5 is a cross-section through a belt and guide devices according to another version of the invention.

The supporting function of the tunnels of the strip sections can also be achieved with other forms of suspension devices. In FIG. 5 these are shown in the form of thicker material 39 with a circular cross-section, whereby the guide devices are modified in a corresponding manner to receive these thicker parts of the material, i.e. guide tubes 40 or guide rails with a downward-facing longitudinal slot 46, whereby the thicker material runs smoothly and without friction inside the tube or rail.

Instead of folding a material belt to form the belt of the packaging blanks it can be formed from two smaller material belts which are placed together and welded, glued or joined in some other manner along an edge to form the bottom sections of the packaging blanks.

The belt of packaging blanks consists of a flexible material which has surfaces which can be welded by heat sealing or which can be glued together or which can be joined in some other manner. A suitable plastic or a laminate which incorporates a suitable plastic layer can be used as the weldable material.

The disclosed guide devices 19, 20 are stationary and completely fixed. The same function of opening the packaging blanks can nevertheless be achieved by means of two straight and movably arranged guide bars which are situated in the same horizontal plane. The guide bars may hereby be capable of parallel lateral movement to outer positions in order to open the packaging blanks or else they may be pivotally journalled at their ends situated downstream so that their free ends can swing out to outer positions in order to open the packaging blanks.

Figure 6:
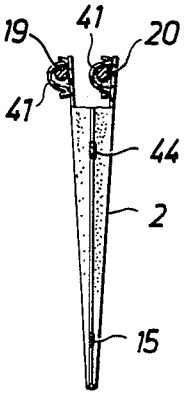
FIG. 6 is a cross-section through a belt and guide devices according to a third version of the invention.

FIG. 6 shows an alternative version of the belt as in FIG. 1, in that the tunnels of the strip sections, instead of folding the walls outward, are formed by separate strips 41 of material which are fixed to the outside of one of the belt walls and to the inside of the other wall.

Figure 7:
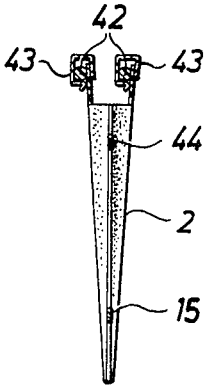
FIG. 7 is a cross-section through a belt and guide devices according to a fourth version of the invention.

FIG. 7 shows an alternative version of the belt and guide devices as in FIG. 5, in that the thicker material of the strip sections instead of being formed by the walls consists of separate round pieces 42 of material which are fixed to the outside and the inside of the belt, whereby the guide devices consist of rails 43 with a downward-facing slot. In the three latter versions (FIGS. 5, 6 and 7) there is also an upper bridge 44 arranged in the vertical slot in the vicinity of the horizontal slot. An upper bridge of this kind is principally easily breakable so that it breaks as a result of the force to which it is subjected when the walls of the belt are forced away from each other in the filling station.

What is claimed is:

1. Apparatus for forming individually filled packages from a continuous flexible belt having two opposing walls and longitudinal first and second edges and including a number of consecutively arranged packaging blanks each with a bottom section at the first edge and two bonding zones arranged transversely in relation to the longitudinal direction of the belt and forming side closures of each packaging blank such that each blank is open at its top at the second edges of the walls, said apparatus comprising means for moving the belt of packaging blanks from an initial holding station past a filling station to a closing station, guide means including two, spaced guide members in the form of bars for slidably holding the belt of packaging blanks at both of its second edges on said guide members such that the entire second longitudinal edges of the blanks of the belt are supported on and constrained by the guide members throughout the path of travel of the blanks from the inital holding thereof through the closing of the blanks while said belt is slidably advanced longitudinally on said guide members, said guide members including spaced portions at said filling station for guidably displacing the second edges of the blanks apart at said filling station while the second edges of the belt slidably advance on the guide members to open the top of the blanks at the filling station such that the blanks are opened at said filling station solely by the guide members over which the blanks are slidingly fed, the thus opened blanks being filled with its contents at said filling station, the blanks advancing beyond the filling station by slidable advance on said guide members, said guide members including converging portions beyond said filling station to close the top of the blanks after filling the same, and means for separating the filled blanks from the remainder of the belt along a longitudinal strip at which the blanks are held by said guide members, said means for removing the belt comprising means for pulling the belt to continuously slidably advance the belt on the guide members from the holding station, through the filling station to the closing station.

2. Apparatus as claimed in claim 1 wherein said guide members are disposed in a horizontal plane to suspend the blanks therefrom.

3. Apparatus as claimed in claim 1 comprising means for sealing the walls of the filled blanks at the closed tops of the blanks.

4. Apparatus as claimed in claim 1 wherein the means for sealing the walls of the filled blanks comprises opposed welding jaws supported for transverse movement towards and away from the walls of the blank.

5. Apparatus as claimed in claim 1 wherein said jaws are disposed for movement at a location spaced from the location at which said second edges are held by the guide members.

6. Apparatus as claimed in claim 1 wherein said guide members comprise tubular bars disposed in a common plane.

7. Apparatus as claimed in claim 1 wherein said tubular bars are hollow and each has a longitudinal slot which opens into the hollow of the tube.

8. Apparatus as claimed in claim 1 comprising means for collecting the longitudinal strip after separation of the filled blanks.

9. Apparatus as claimed in claim 1 wherein said guide members are stationary.

10. Apparatus as claimed in claim 1 wherein said guide members are movable.

11. Apparatus as claimed in claim 1 wherein the means for separating the filled blanks from the remainder of the belt comprises cutting means downstream of said filling station.

12. Apparatus as claimed in claim 1 wherein said cutting means comprises cutting elements for cutting the walls of the belt proximate the second edges thereof.

13. Apparatus as claimed in claim 1 wherein said guide members have terminal ends and said cutting elements are disposed in proximity to said terminal ends to form respective strips coming from said guide members, said apparatus further comprising means for collecting said strips.

14. Apparatus as claimed in claim 1 wherein said means for pulling the belt of packaging blanks comprises means for applying pulling force to said strips.

15. Apparatus as claimed in claim 1 where said means for pulling the belt is located downstream of the closing station.

16. Apparatus as claimed in claim 1 wherein said spaced portions at said filling station are divergent.

* * * * *